United States Patent [19]

Suda

[11] 4,438,922

[45] Mar. 27, 1984

[54] TOY FOR STEERING A SIMULATED CAR

[75] Inventor: Kataro Suda, Tokyo, Japan

[73] Assignee: Suda Kinzoku Seisakusho Co., Ltd., Tokyo, Japan

[21] Appl. No.: 314,445

[22] Filed: Oct. 23, 1981

[30] Foreign Application Priority Data

Feb. 20, 1981 [JP] Japan ..... 56/22884[U]

[51] Int. Cl.[3] ..... A63F 9/14

[52] U.S. Cl. ..... 273/1 GA

[58] Field of Search ..... 46/226, 227, 228, 229, 46/232, 248; 273/86 R, 1 GA, 1 GE; 434/63

[56] References Cited

U.S. PATENT DOCUMENTS 4,231,571 11/1980 Watanabe ..... 273/1 GA

*Primary Examiner*—Mickey Yu

*Attorney, Agent, or Firm*—Young & Thompson

[57] ABSTRACT

A toy for steering a simulated car, wherein cars are pictured on each of two transparent endless belts which are moved by engagement with drums. A light source provides a light for indicating a collision when the pictured car is overlapped with the simulated car moving by a handle in a direction approximately normal to the direction of movement of the belt. The two endless belts are arranged so as to change their moving velocity in relation to each other and the one belt may stop while the other is moving to provide a more interesting toy.

2 Claims, 12 Drawing Figures

TOY FOR STEERING A SIMULATED CAR

FIELD OF THE INVENTION

This invention relates to a toy for steering a simulated car.

More particularly, one aspect of the invention relates to a toy for steering a simulated car, wherein cars are pictured on each transparent endless belt which is moved by engagement with drums, wherein a light source provides a light for indicating collision when the pictured car is overlapped with the simulated car moved by a handle in the direction approximately normal to the direction of motion of the belt, and wherein the two endless belts are arranged so as to change their speed in relation to each other and the one belt may stop while the other is moving, providing a more interesting toy.

Another aspect of the invention relates to a similar toy for steering a simulated car, wherein endless belts each having pictured obstacles thereon are rotated in a housing and the simulated car is moved by a handle attached to the housing in a direction normal to the direction of motion of the endless belt, and wherein overlapping of the simulated car with the obstacle pictured on the endless belt may stop a motor and turns on a lamp, providing a further interesting toy.

SUMMARY OF THE INVENTION

Accordingly, an aspect of the invention is to provide a toy for steering a simulated car, which comprises two shafts arranged in parallel in a housing; two drums mounted separately on each of said shafts, one of said drums being rotatable in relation to the other drum arranged in series therewith; transparent endless belts engaged separately with the drums arranged in parallel on said four drums and each having a number of cars pictured thereon, said endless belts being provided with the same number of cutouts as the number of said pictured cars; gears having different numbers of teeth for forcibly rotating the drums engaged with one of said belts and the drums engaged with the other belt, wherein at least one of gears meshing with two gears arranged on the drum side forming a drive mechanism for said two belts is capable of disengaging from or reengaging with the gears on the drum side by displacement; and a light source arranged between the drums provided with the rotating mechanism; an elastic body for pressing one end of each driven element against the passage through said cutouts of the two belts, said driven element being provided adjacent to its other end with a supporting portion capable of moving together with the simulated car operated by a handle, said supporting portion allowing one or the other of said two driven elements to be supported thereon depending on its position; and a switch provided under said other end of said driven element and switched on by pressure of said driven element for causing an electric current to flow to the light source located between the drums.

Another aspect of the invention is a toy for steering a simulated car, which comprises a base frame secured within a housing; two main shafts arranged in parallel and spaced apart from each other on said base frame; two first drums each secured one on each of said two main shafts; two second drums arranged in series in relation to said first drums and mounted free-rotatably on said main shafts; a first endless belt made of a transparent film and trained about the first drums; a second endless belt made of a transparent film and trained about the second drums; holes passing through each of said first and second belts; an electric lamp arranged between said first and second drums and between the upper and the lower sides of said first and second belts, as well as an electric contact arranged over the position transversed by said holes; a gear fixed to one of said two main shafts; a first interlocking gear meshing continuously with said gear and driven by the drive shaft of a motor, said first interlocking gear being fixed to a sliding shaft; a second interlocking gear fixed to the sliding shaft securing the first interlocking gear and meshing with a gear fixed to one of said second drums, said meshing being disengageable by a sliding movement of said sliding shaft, said second interlocking gear having a different number of teeth from the number of the first interlocking gear; a spring for forcing the sliding shaft securing the first and second interlocking gears toward one direction; a lever protruding out of the housing for forcing the sliding shaft toward the other direction against said spring force; a numerical indicator in the form of drum associated with the other one of said two main shafts; a main switch to be contacted by an outer wall of said numerical indicator and switched on and off by said indicator; a pushbutton for switching on a return switch in the housing; first and a second levers arranged swingably under the position traversed the holes of said first and second belts; springs for forcing one end of each of said first and second levers upwardly; a supporting body having supporting portions for supporting the other ends of said first and second levers from below, said supporting body being reciprocable by a handle arranged outside the housing; a recess located between the two supporting portions of said supporting body and not supporting the other ends of said first and second levers; a simulated car mounted on said supporting body and movable in the direction normal to the moving direction of the belt over said first and second belts; and a simulated obstacle pictured at a position that comes under said simulated car when the holes come in to alignment with said one ends of said first and second levers, said first and second levers being comprised of an electrically conductive material which is connected to a conductor from a power source, said contact being connected through the main switch to a negative side of said power source, said conductors connected to the first and second levers from a positive side of the power source being branched to a return switch, the motor and the main switch in series; a second contacting piece arranged under said one end of said first lever for contact therewith when the other end of the first lever is engaged with the supporting portion of said supporting body; and an insulator arranged on the underside of the one end of said second lever, said insulator allowing a contacting piece arranged on the conductor branched from the conductor on the positive side of the power source to be pressed against and into contact with said second contacting piece when the second lever is supported on the supporting portion.

This invention will be described as to the two embodiments with reference to the drawings, in which:

PREFERRED EMBODIMENT OF THE INVENTION

Figure 1:
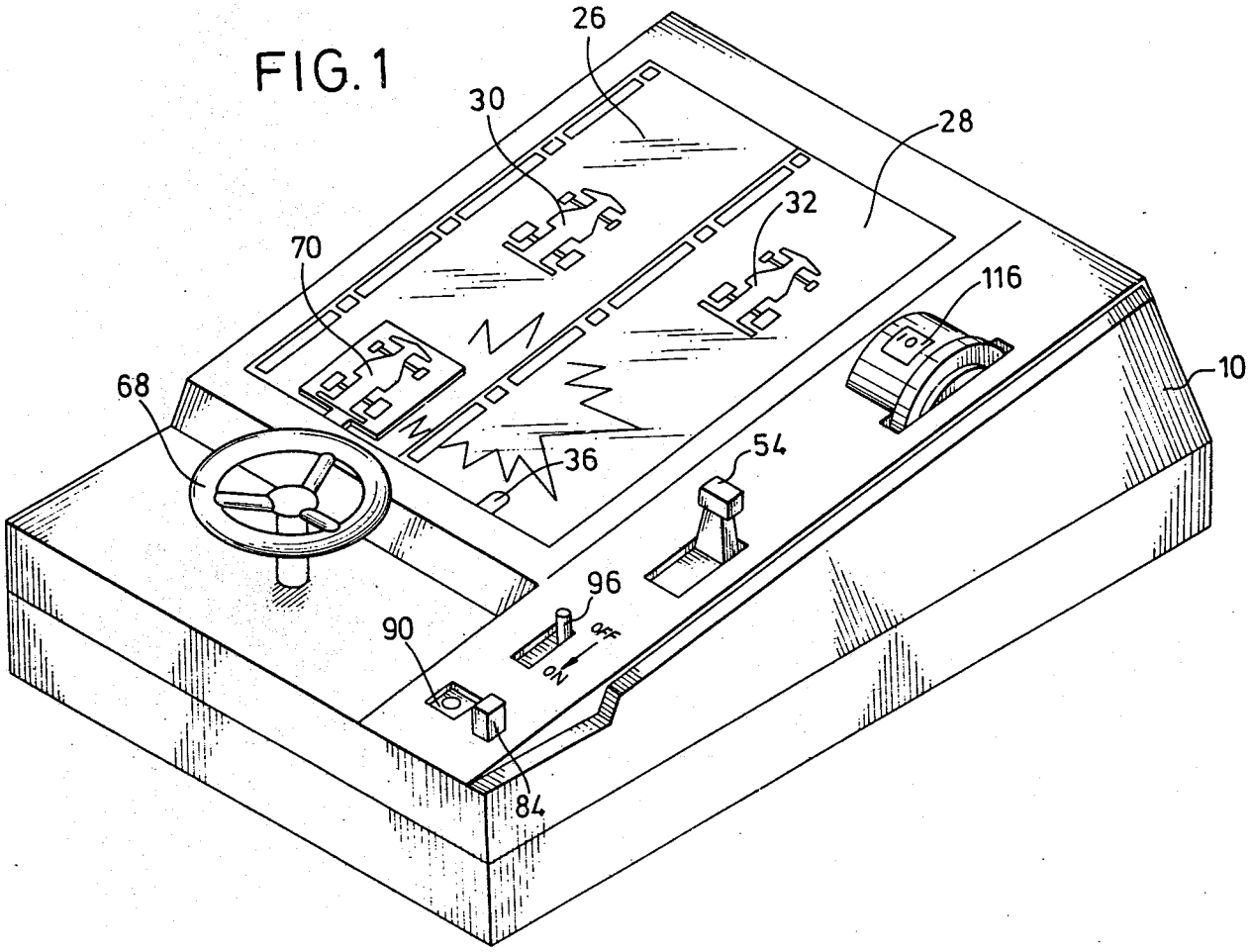
FIG. 1 is a perspective view of a toy for steering a simulated car according to the first embodiment of the invention.
Figure 2:
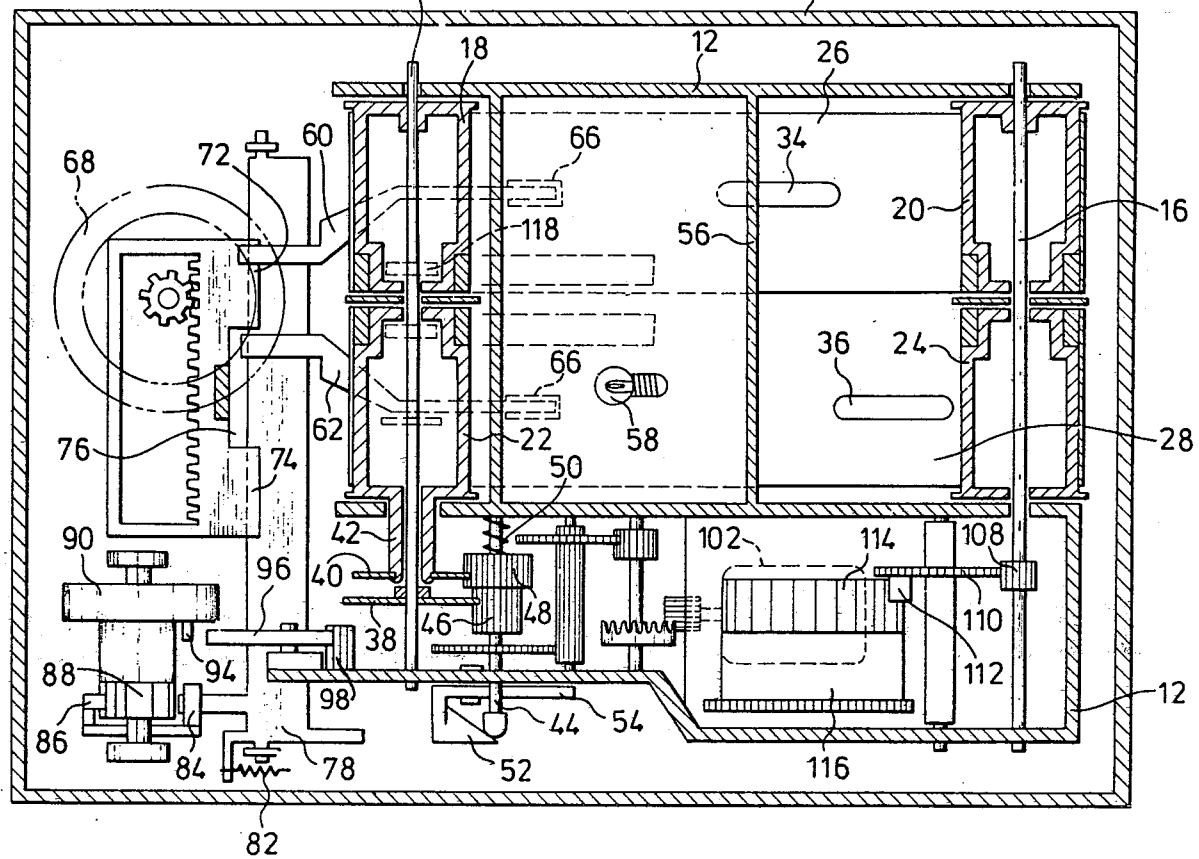
FIG. 2 is a cross-sectional plan view of the toy of FIG. 1.
Figure 3:
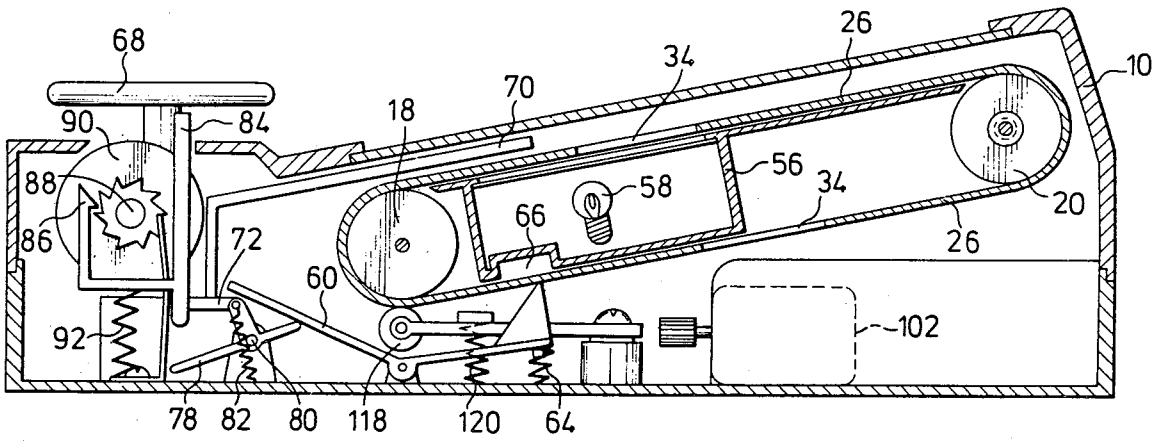
FIG. 3 is a cross-sectional side view of the toy of FIG. 1.
Figure 4:
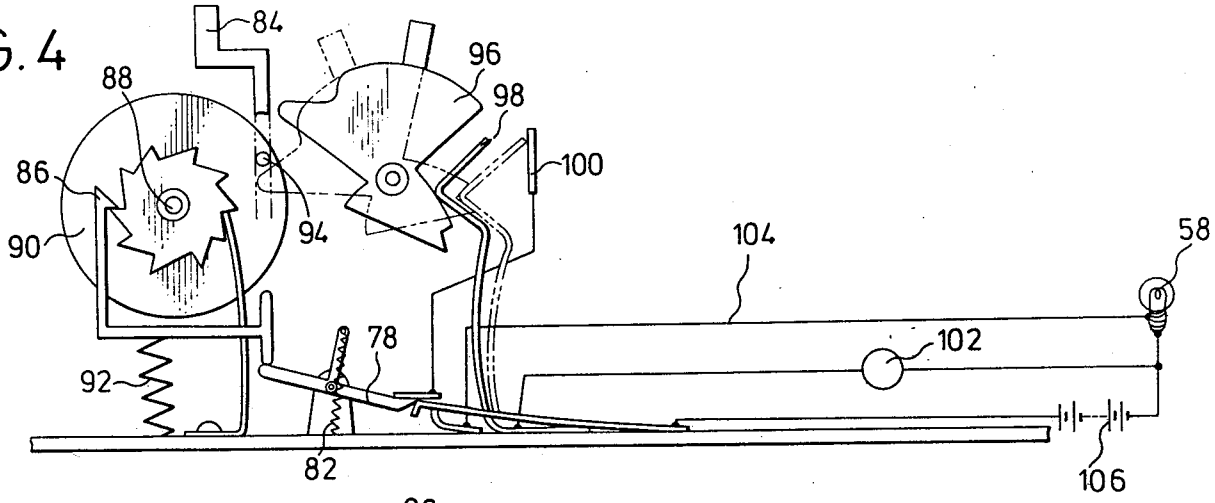
FIGS. 4 and 5 are schematic partial side views of the toy of FIG. 1.
Figure 5:
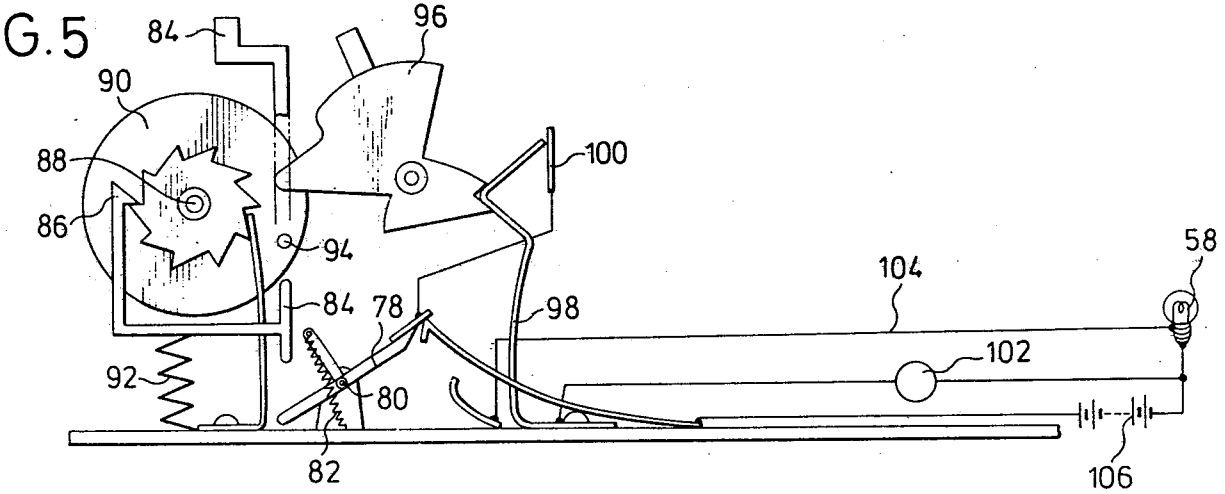
Figure 6:
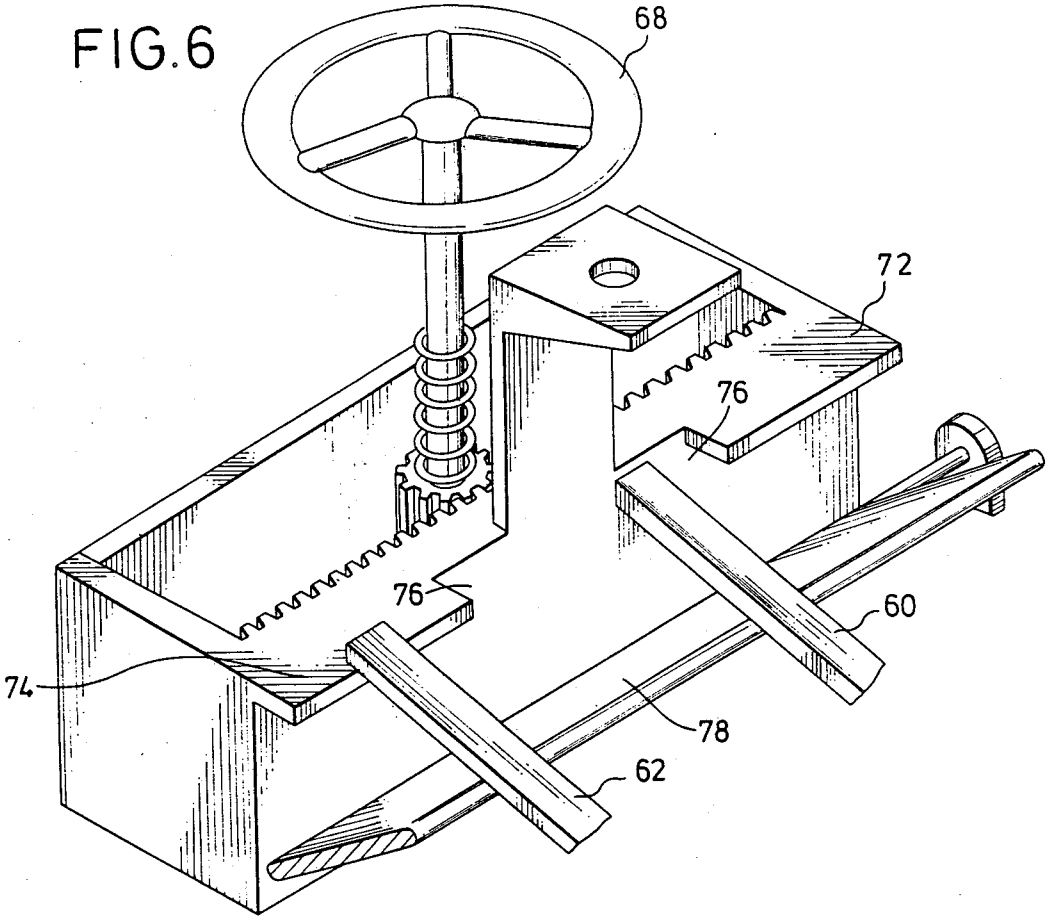
FIG. 6 is a partial perspective view of the toy according to the first embodiment of the invention.

The first embodiment of the invention will be described hereinbelow with reference to the FIGS. 1 to 6.

Two shafts 14 and 16 are arranged in parallel in a base frame 12 secured in a housing 10. Each of the two shafts 14 and 16 is provided with two spaced drums 18, 20 and 22, 24, wherein the drums 18 and 20 are fixed while the other drums 22 and 24 arranged in series in relation to the drum 18 and 20 respectively are rotatable in relation to the shafts 14 and 16. Separate belts 26 and 28 are trained around each two drums 18, 20 and 22, 24 arranged in parallel. Separate cars 30 and 32 are pictured on the belts 26 and 28, respectively, each of which belt is provided with the same number of cutouts 34 or 36 as the number of the pictured cars 30 or 32 so as to locate the cars at the same passing positions in the moving direction of the belt 26 or 28. The drum 18 engaged with the belt 26 and the drum 22 engaged with the other belt 28 are forced to rotate by gears 38 and 40 having different numbers of teeth. The gear 38 is associated with the drum 18 by the shaft 14 therethrough, while the other gear 40 is fixed to a boss 42 of the drum 22. To the frame 12 is attached rotatably and slidably a rotating drive shaft 44, to which in turn is fixed small gears 46 and 48 meshing with the gears 38 and 40 of different numbers of teeth. The small gear 46 has a greater length and continuously meshes with the gear 38 even when the other small gear 48 is disengaged from the gear 40 by sliding the rotating drive shaft 44. This rotating shaft 44 is constantly pressed toward one direction by a spring 50 and is slidable for allowing the small gear 48 to disengage from or remesh with the gear 40 by means of a cam 52 which is integral with the lever 54 capable of being operated outside the housing 10. A light source 58, such as an electric lamp, is arranged in a receiving space 56 between the drums 18, 22 and the drums 20, 24. Each driven element 60, 62 in the form of a lever is pressed at its one end against the portion passing through each cutout 34, 36 of the endless belt 26, 28 by pressure of an elastic body 64. The receiving space 56 is provided at its bottom with a recess 66 for receiving one end of the driven element 60, 62 when it comes to alignment with the cutout 34, 36 of the endless belt 26, 28. Adjacent to the other end of the driven element 60, 62 is located an arresting portion 72, 74 for arresting the other end of the driven element 60, 62 and preventing the one end thereof from entering the recess 66 even when the one end comes to alignment with the cutout 34, 36 of the endless belt 26, 28. The arresting portion 72, 74 can move together with a simulated car 70 capable of sliding horizontally by means of a handle 68. A recess 76 is provided between the arresting portions 72 and 74 for freeing the other end of the driven element 60, 62. When the other end of one driven element 60 is arrested by one arresting portion 72, the other end of the other driven element 62 is located in the recess 76. When the other end of the other driven element is arrested by the other arresting portion 74, on the contrary, the other end of the driven element 60 is located in the recess 76. Under the arresting portions 72, 74 and the recess 76 is provided a switch 78 which is operated by pressure of the other end of the driven element 60, 62 and permits the electric current to flow to the light source 58.

The switch 78 is pivotable on a shaft 80. A spring 82 is arranged for urging the switch 78 to swing on the axis of the shaft 80. For actuating the switch 78 a pushing element 84 is extended at its end out of the housing 10, with which the switch 78 is pushed down at its one end opposite to the contacting piece. A pawl 86, which is integrated with the pushing element 84, may permit a ratchet wheel 88 to rotate tooth by tooth, so that a RAM-type counter 90 integrated with the ratchet wheel 88 may be intermittently rotated each time the light source 58 is extinguished. A spring 92 for continuously urging the pushing element 84 toward its upward position, as well as a pin 94 protruding from the counter 90 may force a main switch 96 to move upwardly upon each rotation of the counter 90 so that the contact of contacting pieces 98 and 100 may be released. A conductor 104 and a power source 106 are illustrated in the drawing but without limitation. To the shaft 16 on which the drums 20 and 24 are mounted is fixed a small gear 108, with which is meshed a gear 110 securing a pin 112. The pin 112 permits intermittent rotation of a ratchet wheel 114 together with a counter 116 for detecting the rotation of the drum 20 or the distance traveled by the endless belt 26. Friction wheels 118 press against the drums 18 and 22 through the endless belts 26 and 28. A contacting portion of the friction wheel 118, against which a friction part of the drum 18 or 22 is pressed, is provided with a high-friction material such as rubber, so that the endless belt 26, 28 may be smoothly rotated through rotation of the drum 18, 22 even when a gap occurs between the drum and the endless belt. A spring 120 may ensure the pressure contact of the friction wheel 118 with the drum 18, 22.

In accordance with the embodiment described hereinabove, the main switch 96 in its ON position may permit the contacting pieces 98 and 100 to contact each other for conducting an electic current to a motor 102, the rotation of which in turn may rotate the drum 18 together with the endless belt 26 through a series of gears as well as the small gear 46 and the gear 38. The other drum 22 engaging with the other endless belt 28 may be rotated at a faster speed than the drum 18 by means of a combination of the small gear 48 having a greater number of teeth than the small gear 46 with the gear 40 having a smaller number of teeth than the gear 38. Thus, there is a difference in speed between the endless belt 26 and the other belt 28.

If the simulated car 70 is moved by the handle 68 during movement of the endless belt 26, 28, then the driven element 60, 62 at its other end is arrested by the arresting portion 72, 74 through the interlocking movement with the simulated car 70. The arresting portion 72, 74 may move so as to prevent the one end of the driven element 60, 62 from entering the recess 66 even upon the alignment of the one end with the cutout 34, 36 of the endless belt 26, 28. Thus, the movement of the endless belt 26, 28 may be continued by avoiding the overlapping of the simulated car 70 and the pictured cars 30, 32 without energizing the light source 58. When the simulated car 70 overlap with one of the pictured cars 30, 32 on the endless belt 26, 28, the other end of the driven element 60, 62 is not arrested by the arresting portion 72, 74. Thus, the one end of the driven element 60, 62 comes to alignment with the cutout 34, 36 and enters the recess 66 by pressure of the elastic element 64, thereby to push the switch 78 for lighting the light source 58. In this case, the flow of current to the motor 102 may be diverted to the light source 58 for discontinuing the operation of the motor 102. The diversion of the current flow again to the motor 102 restarts the rotation of the motor 102 and turns off the light source 58. Alternatively, another conductor is possible for simultaneously conducting both the lighting of the light source 58 and the stopping of the motor 102. With another wiring the counter 90 may be advanced one unit upon each opening of the switch 78. In accordance with the embodiment described hereinbefore, engagement of the small gear 46 with the gear 38 will continue even when the other small gear 48 is disengaged from the gear 40 by operating the lever 54 from outside the housing 10, so that the endless belt 28 may stop moving while the other belt 26 may keep moving. Thus, the simulated car 70 may be transferred from the stopped belt 28 to the still moving belt 26 by manipulation of the handle. In this way, the moving speed of the endless belts 26 and 28 may be differentiated from each other, or either one belt may be stopped while the other is moving, thus providing an interesting game.

Figure 7:
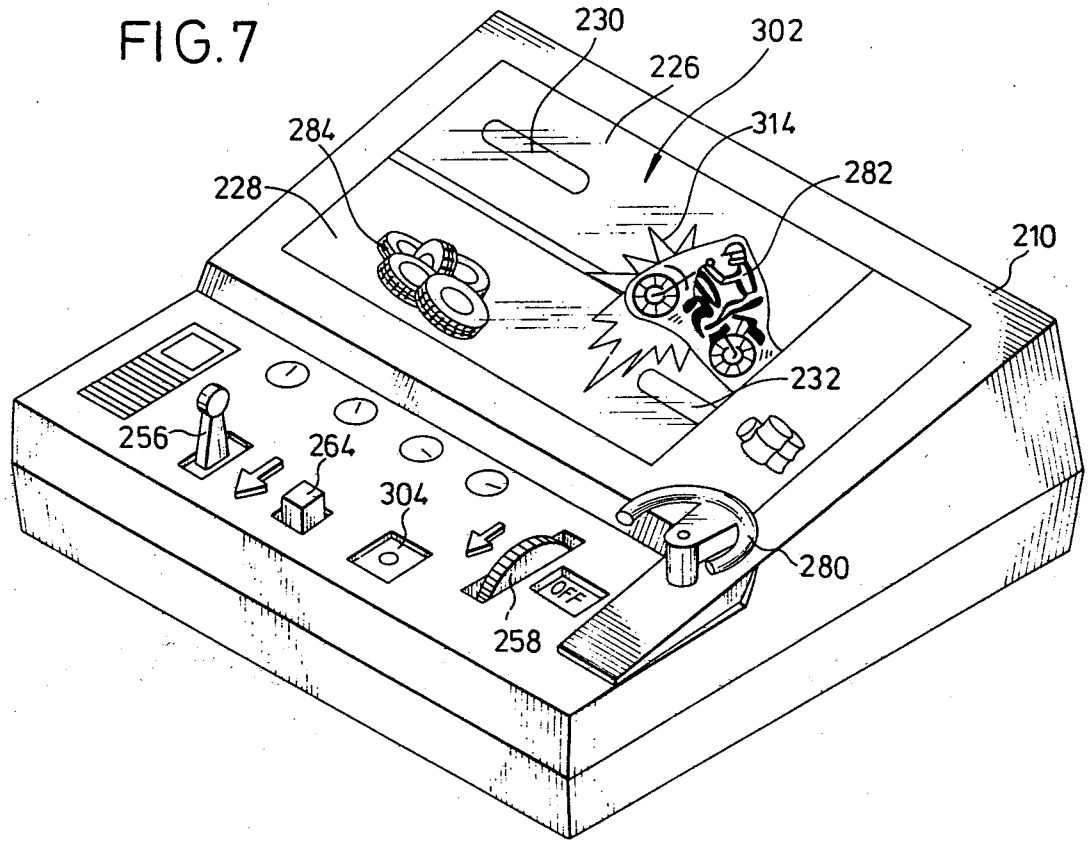
FIG. 7 is a perspective view of a toy for steering a simulated car according to the second embodiment of the invention.
Figure 8:
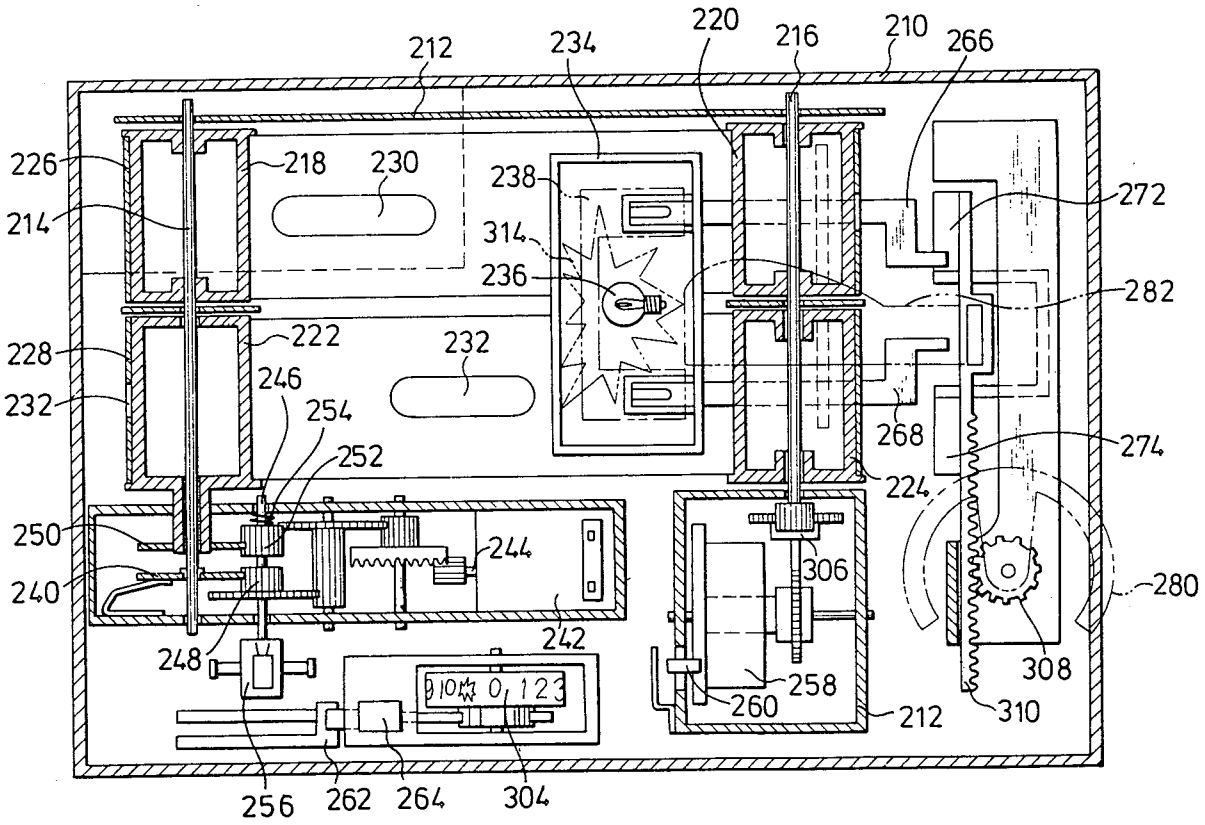
FIG. 8 is a cross-sectional plan view of the toy of FIG. 7.
Figure 9:
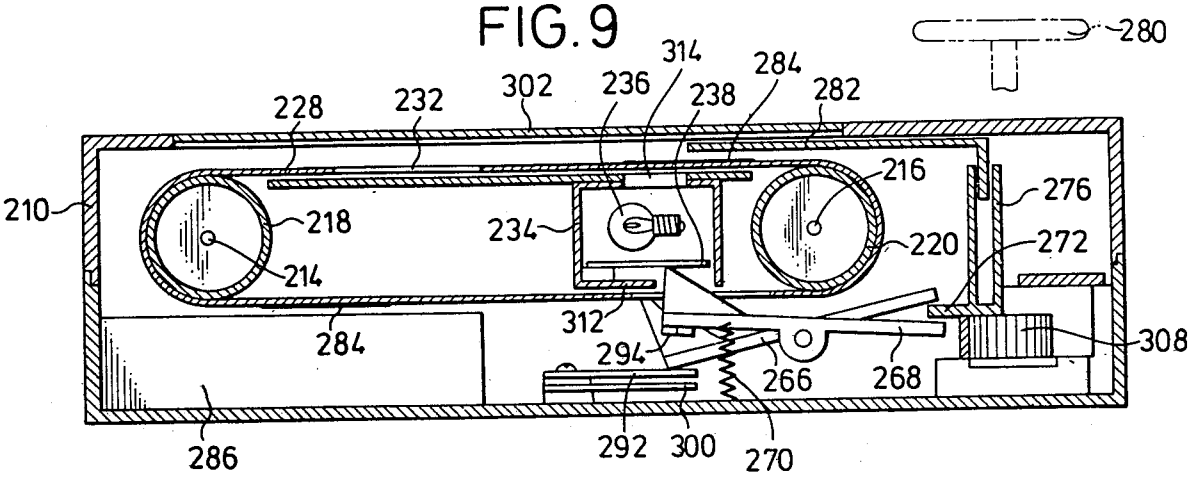
FIGS. 9 and 10 are cross-sectional side views of the toy of FIG. 7.
Figure 10:
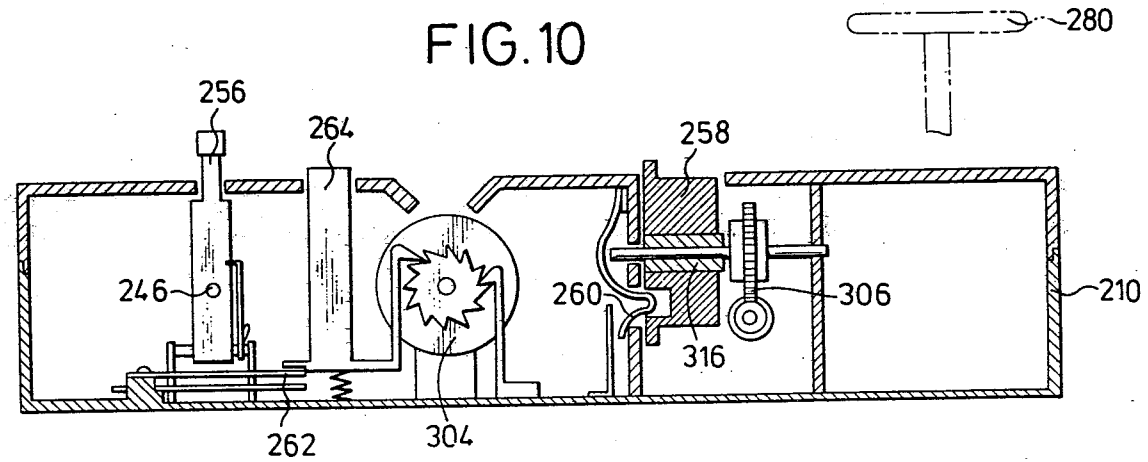
Figure 12:
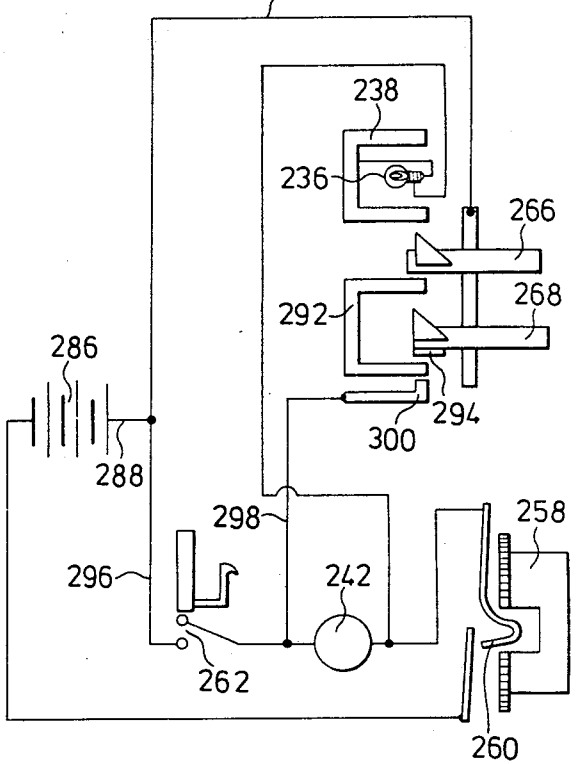
FIG. 12 is an electrical circuit used in the toy according to the second embodiment of the invention.
Figure 11:
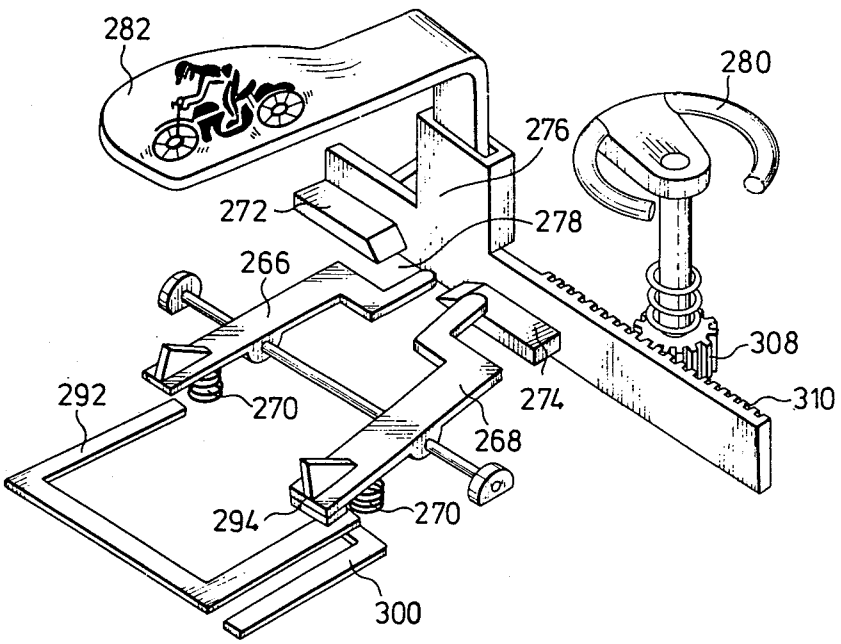
FIG. 11 is a partial perspective view of an internal mechanism.

The second embodiment will now be described hereinbelow with reference to FIGS. 7 to 12. In a housing 210 is secured a base frame 212, in which are supported two main shafts 214, 216 in parallel and spaced apart from each other. Two first drums 218, 220 are fixed to the main shafts 214, 216, in which are also free-rotatably arranged two second drums 222, 224 in series relative to the first drums 218, 220. A first endlss belt 226 made of a transparent film is trained about the first drums 218, 220, while a second endless belt 228 made of a transparent film is trained about the second drums 222, 224. Both the endless belts 226 and 228 are provided with holes 230 and 232, respectively. Between the first drums 218, 220 and the second drums 222, 224 and between the upper and the lower sides of the first and second belts is arranged a box 234 which receives an electric lamp 236, while an electrical contact 238 is arranged over the position traversed by the holes 230 and 232. To one shaft 214 is fixed a gear 240 which meshes continuously with a first interlocking gear 248. The first interlocking gear 248 is associated with a driving shaft 244 of a motor 242 and is fixed to a sliding shaft 246. A second interlocking gear 252 is fixed to the sliding shaft 246 securing the first interlocking gear 248. The second interlocking gear 252 meshes with a gear 250 fixed to one of the second drums and has a different number of teeth from the first interlocking gear 248. The engagement of the second interlocking gear 252 with the gear 250 may be released by the sliding movement of the sliding shaft 246. A spring 254 is provided for forcing the sliding shaft 246 toward one direction. For forcing the sliding shaft 246 toward the other direction against the force of the spring 254, a lever 256 is extended at its one end out of the housing 210. A drum-type numerical indicator 258 is associated with the other main shaft 216, the outer wall of which indicator is contacted by a main switch 260. Thus, the main switch 260 is operated by the numerical indicator 258. Within the housing 210 is also arranged a return switch 262 which is operated by a push button 264. Under the position traversed by the holes 230, 232 of the first and second belts 226, 228 are swingably arranged a first and a second lever 266 and 268. Springs 270 are provided for forcing one end of each of the first and second levers 266, 268 upwardly, while a supporting body 276 is provided with supporting portions 272, 274 for supporting the other ends of the first and second levers. The supporting body 276 may be reciprocated by a handle 280, a portion of which is exposed outside the housing 210. Furthermore, a recess 278 is provided between the two supporting portions 272 and 274 of the supporting body 276 for releasing the other ends of the first and second levers 266, 268. A simulated car 282 is mounted on the supporting body 276 and is movable toward the direction normal to the moving direction of the belts over the first and second belts 226, 228. On the other hand, a simulated obstacle 284 is pictured on the belt at a position that comes under the simulated car 282 when the holes 230, 232 come to alignment with the one ends of the first and second levers 226, 228. The first and second levers 266, 268 are made of an electrically conductive material, to which is connected a conductor 288 from a power source 286. The contact 238 is connected through the main switch 260 to the negative side of the power source 286, while a conductor 290 is branched from the positive side of the power source for connecting to the first and second levers 266, 268 and arranging the return switch 262, the motor 242 and the main switch 260 in series. Under the one end of the first lever 266 is provided a second contacting piece 292, by which the first lever 266 is contacted when the other end of the first lever 266 rests on the supporting portion 272, while an insulator 294 is provided at the bottom of the second lever 268 at its one end. The insulator 294 allows a contacting piece 300 to be pressed into contact with the second contacting piece 292 when the second lever 268 is supported on the supporting portion 274. The contacting piece 300 is provided with a conductor 298 which is branched from a conductor 296 on the positive side of the power source 286.

A transparent plate 302 is extended on the housing 210 over the belts for prevention of touching the first and second belts 226, 228. For enjoying the game, a penalty indicator 304 is provided, the numerical indication of which may be changed by each operation of the pushing button 264. Furthermore, there are arranged a series of gears 306 for interlocking the main shaft 216 with the numerical indicator 258, a pinion 308 fixed to the handle 280, and a rack 310 which is a part of the supporting body 276 and meshes with the pinion 308, as well as a bottom part 312 of the box 234 for minimizing distortion of the belts when the one ends of the first and second levers are pressed against the first and second belts 226, 228. The box 234 is provided with a cutout 314 for observing the light of the lamp 236 from outside. A friction part 316 is arranged between the indicator 258 and the gear series 306 for protecting the gear series, such as a worm gear when the numerical indicator 258 is forcibly rotated.

In accordance with the second embodiment described hereinbefore, if the numerical indicator 258 is forcibly rotated to put the main switch 260 in its ON position and if both the first and second levers 266 and 268 are not engaged in the holes 230 and 232, then the first lever 266 is contacted at its one end by the second contacting piece 292 while the second lever 268 at its one end allows the second contacting piece 292 to contact the contacting piece 300. Thus, the power source 286, the wiring 290, the first lever 266, the second contacting piece 292, the contacting piece 300, the motor 242 and the main switch 260 provide a circuit for driving the motor 242.

If one end of either the first lever 266 or the second lever 268 is engaged in the hole 230 or 232, then the contact of the first lever with the second contacting piece 292 is released, or the second lever 268 releases the contact of the second contacting piece 292 with the contacting piece 300 to discontinue the operation of the motor 242. In this case, the one end of the lever 266, 268 passes through the hole 230, 232 and contacts the electric contact 238 for lighting the lamp 236.

In order to restart the game, the pushbutton 264 is depressed for switching on the return switch 262. Thus, the motor 242 is forcibly rotated to move the belts and to dislocate the holes 230, 232 of the belts 226, 228 from the one end of the levers 266, 268 thereby restoring the contact of the first lever 266 with the second contacting piece 292 as well as the contact of the second contacting piece 292 with the contacting piece 300 through the second lever 268 for maintaining the operation of the motor 242. When either one of the supporting portions 272, 274 supports the other end of the lever 266 or 268 to prevent the lever from swinging, the contact of the lever 266 with the second contacting piece 242 as well as the contact of the second contacting piece 292 with the contacting piece 300 will be maintained for continuing the operation of the motor 242 even when the one end of the lever 266, 268 comes into alignment with the hole 230, 232. In this case, the lamp 236 never turns on. The supporting body 276 is provided the recess 278 between the supporting portions 272 and 274, in which is located either one of the first and second levers 266, 268. Then, the lever having the other end located in the recess can enter the hole when the one end comes into alignment with the hole.

The simulated car 282 is mounted on the supporting body 276 which is movable transversely by the handle 280 through, for example, the pinion 308 and the rack 310. When the obstacle 284 pictured on the belt 226 or 228 is overlapped with the simulated car 282 and thereby the other end of either the first or the second lever 266, 268 is located in the recess 278, the alignment of the hole 230, 232 with the one end of the lever 266, 268 allows the motor 242 to stop and the lamp 236 to turn on.

Further in accordance with the second embodiment of the invention, the first interlocking gear 248 rotating the first drums 218, 220 has a different number of teeth from the second interlocking gear 252 rotating the second drums 222, 224, so that the speed of the first belt 226 may be different from that of the second belt 228, providing a more interesting game.

By operating the lever 256 to disengage the gear 250 from the second interlocking gear 252, the movement of the second belt 228 may be optionally discontinued thereby avoiding the overlapping of the simulated car 284 with the simulated obstacle 282, namely an apparent collosion.

Still further in accordance with the second embodiment, the main switch 260 is operated by the numerical indicator 258 which in turn is interlocked with the main shaft 216 or the drums through the gear series 306, so that the number of rotations of the drum or the distance traveled by the belt 226 is indicated on the numerical indicator 258. Each rotation of the numerical indicator 258 may switch off the main switch 260 to discontinue all the current flow and therefore the operation of the motor 242, leading to the end of the game.

The invention has been described hereinabove with reference to the two embodiments but shall not be limited thereto, and many variations and modifications will be apparent to any one skilled in the art without departing from the scope of the invention.

What is claimed is:

1. A toy for steering a simulated car, which comprises two shafts arranged parallel in a housing; two drums mounted separately on each of said shafts, one of said drums being rotatable in relation to the other drum on the same shaft; two light transmissive endless belts disposed side by side, one said belt being trained over one drum on each shaft and each said belt having a number of cars pictured thereon, said endless belts being provided with the same number of cutouts as the number of said pictured cars; gears having different numbers of teeth for drivingly rotating one of the drums engaged with one of said belts and one of the drums engaged with the other belt; drive means for driving said gears and for selectively interrupting the drive to one of said gears; a light source arranged between the drums; an elastic body for pressing one end of each of a pair of driven elements against cutouts of the two belts, each of said driven elements being provided adjacent to its other end with a support portion capable of moving together with a simulated car operated by a handle, said support portion allowing one or the other of said one ends of said driven elements to be supported thereon depending on its position; and a switch under the other end of each said driven element and switched on by pressure of said driven element for causing an electric current flow to said light source.

2. A toy for steering a simulated car, which comprises a base frame secured within a housing; two main shafts arranged in parallel and spaced apart from each other on said base frame; two first drums one secured to each of said two main shafts; two second drums arranged in series with said first drums and mounted free-rotatably on said main shafts; a first endless belt formed from a transparent film and trained about the first drums; a second endless belt formed from a transparent film and trained about the second drums; holes passing through each of said first and second belts; an electric lamp arranged between said first and second drums and between the upper and the lower sides of said first and second belts, as well as an electric contact arranged over the position traversed by said holes; a gear fixed to one of said two main shafts; a first interlocking gear meshing continuously with said gear and driven by a driving shaft of a motor, said first interlocking gear being fixed to a sliding shaft; a second interlocking gear fixed to the sliding shaft securing the first interlocking gear and meshing with a gear fixed to one of said second drums, said meshing being disengageable by a sliding movement of said sliding shaft, said second interlocking gear having a different number of teeth from the first interlocking gear; a spring for forcing the sliding shaft securing the first and second interlocking gears toward one direction; a lever protruding from the housing for forcing the sliding shaft toward the other direction against the force of said spring; a numerical indicator in the form of a drum rotated by the other one of said two mainshafts; a main switch to be contacted with an outer wall of said numerical indicator and switched on or off by said indicator; a pushbutton for switching on a return switch in the housing; first and second levers arranged swingably under the position traversed by the holes of said first and second belts; springs for forcing one end of each of said first and second levers upwardly; a supporting body having supporting portions for supporting the other ends of said first and second levers from below, said supporting body being movable by a handle outside the housing; a recess located between the two supporting portions of said supporting body and not supporting the other ends of said first and second levers; a simulated car mounted on said supporting body and movable in the direction normal to the direction of movement of said first and second belts; and a simulated obstacle pictured at a position that comes under said simulated car when the holes come into alignment with said one ends of said first and second levers on the first and second belts, said first and second levers being comprised of an electric conductor which is connected by a conductor from a power source, said contact being connected through the main switch to a negative side of said power source, conductors connected to the first and second levers from a positive side of the power source and branched to the return switch, the motor and the main switch in series; a second contact arranged under said one of said first lever for contact therewith when the other end of the first lever is engaged with a said supporting portion of said supporting body; and an insulator arranged on the underside of said one end of said second lever, said insulator allowing a contact on the conductor branched from the conductor on the positive side of the power source to be pressed against and into contact with said second contact when the second lever is supported on a said supporting portion.

* * * * *